US006881021B1

(12) United States Patent
Winter et al.

(10) Patent No.: US 6,881,021 B1
(45) Date of Patent: Apr. 19, 2005

(54) TELESCOPIC JIB FOR A MOTOR VEHICLE OR A CRANE

(76) Inventors: Udo Winter, Losensteinerstrasse 23, Linz (AT), A 4020; Johann Schabelreiter, Kirchdorf 37, Pernegg (AT), A 8132; Werner Martin, Simchengasse 2, Graz (AT), A 8020

( * ) Notice: Subject to any disclaimer, the term of this patent is extended or adjusted under 35 U.S.C. 154(b) by 0 days.

(21) Appl. No.: 09/979,591

(22) PCT Filed: May 10, 2000

(86) PCT No.: PCT/AT00/00128

§ 371 (c)(1),
(2), (4) Date: Nov. 16, 2001

(87) PCT Pub. No.: WO00/69770

PCT Pub. Date: Nov. 23, 2000

(30) Foreign Application Priority Data

May 18, 1999 (AT) ..... A 878/99

(51) Int. Cl.[7] ..... B65F 3/00

(52) U.S. Cl. ..... 414/420; 212/231; 212/348; 212/349; 414/543; 414/547; 294/68.26

(58) Field of Search ..... 212/349, 231, 212/232, 348, 350; 414/546, 547, 543, 420, 486, 491, 626; 294/68.26

(56) References Cited

U.S. PATENT DOCUMENTS 3,253,851 A * 5/1966 Gilbert ..... 294/119.2
3,715,039 A * 2/1973 Kollmann et al. ..... 212/349
3,837,502 A 9/1974 Hornagold
5,330,308 A * 7/1994 Armando et al. ..... 414/408

FOREIGN PATENT DOCUMENTS

| | | | |
|---|---|---|---|
| AT | 117 423 | 1/1976 | |
| CN | 374 292 | 2/1964 | |
| CN | 436 646 | 11/1967 | |
| DE | 12 84 597 | 12/1968 | |
| DE | 23 56 904 | 5/1975 | |
| DE | 27 21 636 | 12/1977 | |
| DE | 38 04 557 | 8/1989 | |
| DE | 43 20 344 | 8/1994 | |
| EP | 0 018 466 | 11/1980 | |
| EP | 0 727 384 | 8/1996 | |
| FR | 1552034 | * 11/1968 | ..... 212/231 |
| FR | 1 552 034 | 1/1969 | |
| FR | 2 073 704 | 10/1971 | |
| FR | 2 355 767 | 1/1978 | |
| GB | 1 550 072 | 8/1979 | |

* cited by examiner

*Primary Examiner*—Thomas J. Brahan
(74) *Attorney, Agent, or Firm*—Collard & Roe

(57) ABSTRACT

A telescopic boom (1) for a vehicle (25) or a hoist with a storage rack (6) for at least two box girders (2, 3) guided displaceably in one another in the direction of their longitudinal axes, which are mounted to pivot about a horizontal pivot axle (5) in the storage rack (6) and which can be displaced reciprocally by means of a servo-drive (19) is described. In order to create advantageous structural conditions it is proposed that the longitudinal axles of the box girders (2, 3) form an upwards arched arc of a circle (4) which runs concentrically to a common axis parallel to the pivot axis (5).

7 Claims, 11 Drawing Sheets

TELESCOPIC JIB FOR A MOTOR VEHICLE OR A CRANE

CROSS-REFERENCE TO RELATED APPLICATIONS

Applicants claim priority under 35 U.S.C. §119 of Austrian Application No. A 878/99 filed May 18, 1999. Applicants, also claim priority under 35 U.S.C. §365 of PCT/AT00/00128 filed May 10, 2000. The international application under PCT article 21(2) was not published in English.

BACKGROUND OF THE INVENTION

1. Field of the Invention

The present invention relates to a telescopic boom for a vehicle or a hoist with a storage rack for at least two box girders guided displaceably in one another in the direction of their longitudinal axes, which are mounted to pivot about a horizontal pivot axle in the storage rack and which can be displaced reciprocally by means of a servo-drive.

2. Description of the Prior Art

Known telescopic booms of this type (DE 27 21 636 A1, DE 38 04 557 A1) have box girders guided in one another which can be displaced reciprocally along a straight line by means of a ram. The lower one of the box girders can be pivoted in a storage rack about a horizontal pivot axis and be pivoted with the bogie about a vertical axis, so that the load suspension arranged at the front end of the telescopic boom can be moved freely in a spatial area created by the possible pivot or swing angle and the extension length. If in the process the load suspension is arranged on a swivel head pivoting about a vertical axis, then in addition the load alignment can be selected independently of the respective pivot adjustment of the telescopic boom relative to the vertical axis of the storage rack. The design of the individual sections of the telescopic boom as box girders not only offers advantages with respect to the carrying capacity of the telescopic boom, but also with respect to arrangement of the servo-drive for extending and retracting the telescopic boom as well as to the placing of supply lines, because the servo-drive and the supply lines can be placed inside the box girders. This applies in particular for an embodiment (DE 27 21 636 A1) wherein the upper and the lower wall of the box girder, which is guided in the box girder on the storage rack side, exhibit longitudinal edge frames projecting over the box profile and guided on the box girder on the storage rack side, which with angled edge sections form takeup grooves for supply lines for hydraulic supply of rams of the load suspension. But the disadvantage of these known telescopic booms is that a linear, free passage for the telescopic arm has to be available between the point to be reached by the front end of the telescopic boom and the storage rack, which is, however, often not present, for example not if the telescopic boom is to be inserted into a space overhead through lateral openings. The higher such a lateral aperture lies above the storage rack, the more steeply therefore the telescopic arm has to be mounted about its horizontal pivot axis, the less the possible horizontal penetration width of the telescopic boom through the lateral opening becomes. To avoid this drawback the boom can be provided as a buckling arm with an articulated partitioning, though such buckling arm booms necessitate substantially higher structural and control expenses.

SUMMARY OF THE INVENTION

The object of the invention is to arrange a telescopic boom for a vehicle or a hoist of the type described at the outset such that places can be reached with the telescopic boom, between which and the storage rack there is no free linear passage, without having to fall back on an additional articulated partitioning of the boom.

The invention solves this task by the fact that the longitudinal axles of the box girders form an upwards arched arc of a circle which runs concentrically to a common axis parallel to the pivot axis.

Since, as a result of these measures, the box girders are pushed towards one another along a curved path, free linear passage for the telescopic boom is no longer required, which considerably expands the area of application of telescopic boom according to the present invention as compared to conventional telescopic booms. The horizontal components of the extension movement by box girders formed in an arc of a circle becomes overproportionally greater with increasing extension length, in particular with steeper set angles of the telescopic boom, such that such telescopic booms are particularly suitable for reaching spaces which are accessible overhead via a lateral opening.

Because of the arrangement of the box girders concentric to a common axis there are no particular difficulties with respect to the reciprocal guiding of the box girders above the cylindrical walls. The box girders, which engage in one another with play, can be mutually supported in the usual way by slideways which are arranged in the vicinity of the front or rear girder end of the intermeshing box girders, due to the required torque support. To be able to guarantee a greater area of tolerance for the curving of the box girders, the slideways can be swivel-mounted on the girder ends about an axle parallel to the pivot axle, so that there is automatic adaptation to the respective curving of the cylindrical walls of the box girders in the region of these load-reducing slideways.

Whereas mutual adjustment of the intermeshing box girders produces no difficulties with use of a cylindrical pinion in the case of straight telescopic booms, the arrangement of a cylindrical pinion inside the box girders in the case of box girders curved to an arc of a circle requires special measures, since by means of a linear extending ram the curved form of the box girders cannot be considered. For this reason the cylindrical pinion may comprise two rams which are on the one hand articulated to one of the outer girder ends and on the other hand to a common slider mounted displaceably inside the box girder, such that the rams form a progression adapted to the circular arc shape, in such a way that the rams extend chord-like inside the box girders in linear fashion. The slider mounted displaceably inside the inner box girder between both rams enables simple mutual displacement of the box girders with simultaneous removal of the radial components of the controlling torque on the box girders. A servo-drive is also proposed for mutual displacement of the box girders however, comprising at least one rack running along a box girder and one driving pinion of the other box girder meshing with the rack, so that the box girder connected to the driving pinion is driven along the other box girder with the drive of the driving pinion.

It is evident that the arc-shaped box girders according to the present invention can also be employed to accommodate supply lines, if the upper and the lower cylindrical wall of the inner box girder form, in a manner known per se, longitudinal edge frames projecting laterally over the box profile and guided on the outer box girder, between which longitudinal channels for taking up these supply lines are formed on the outer sides of the box profile of the inner box girder. These supply lines can serve various purposes, according to the use of the telescopic boom. Accordingly, when telescopic booms according to the present invention are used for fire engines, guide hoses for extinguishers can be laid in these longitudinal channels next to the supply lines for the equipment taken up by the telescopic boom. If supply lines of a larger diameter are required, as is the case for supplying fresh concrete or mortar for example, the box profile of the inner box girder can also be employed as a supply line, so that the cross-section of the box girders does not have to be enlarged. In this case, however, the servo-drive cannot be arranged inside the box profile. For this reason the servo-drive may comprise a rack-and-pinion gear, such that the rack of the servo-drive is to be provided in at least one of the longitudinal channels resulting between the longitudinal edge frames outside the box profiles on both sides of the inner box girder, so that the box profile is free for supply.

To further expand the reach of the telescopic boom the box girder forming the overhanging boom end can bear a boom arm pivoting about a horizontal pivot axis and possibly extending telescopically, which considerably increases the reach of the telescopic boom in cooperation with the circular arc of the telescopic boom on account of its pivoted configuration; this is of particular significance for telescopic booms which are used with feed pipes for different goods, e.g. liquids, liquid-solid mixtures or pourable goods.

Telescopic booms for vehicles generally have only two intermeshing box girders so as not to rise above preset contours of the vehicle. A simple arrangement of three box girders guided displaceably in one another is created with an economic arrangement if the box girder swivel-mounted in the storage rack is designed shorter than the middle box girder telescoping upwards and downwards from the box girder on the rack side, because utilisation of the space underneath the rack for lowering the middle box girder allows arrangement of a three-part telescopic boom inside the admissible contours of the vehicle. In this connection it should be considered that with box girders curved in the form of a circular arc not only the length of the telescopic boom, but also its greater horizontal extension determined by the circular form is to be taken into consideration.

As already pointed out, telescopic booms according to the present invention can be used in multiple applications. Inter alia it is possible to utilise the box girders not only for guiding supply lines, but also to design them as accessible and/or navigable tunnel. These correspondingly large-sized box girders can advantageously facilitate connecting an aircraft exit hatch to the ground, with the added advantage that, despite different exit hatch paths, the connection end of the telescopic boom on the aircraft runs approximately horizontally, before the tunnel floor gradually inclines downwards to overcome the height. The circumstances by which the telescopic boom can be joined to an opening at a distance above an accessible surface with minimal inclination, makes telescopic booms with box girders forming a tunnel also suitable for creating emergency and escape routes, particularly as these emergency and escape routes are protected at least partially from outside influences by the box girders enclosing them.

Another area of application of telescopic booms according to the present invention is in vehicles which pick up set-down bins. Such vehicles are fitted with telescopic booms which have at their front end a pivot head for load suspension gear which forms a cross-beam with traction mechanisms arranged laterally in pairs for hanging the bins. When the telescopic boom is adjusted along a circular path the advantages associated with such a telescopic boom for setting down and picking up bins can be utilised to particular advantage. At the same time at least one of the traction mechanisms arranged in pairs can be shifted on each side of the cross-beam relative to the traction mechanism assigned to it, to enable the bins to be tipped and emptied using the different lever length of the traction mechanisms. Although the drive for adjusting the traction mechanisms can be varying in design, particularly simple structural ratios result if the adjustable traction mechanisms engage in hydraulic jacks mounted in the cross-beam, so that when these hydraulic jacks are supplied the bin suspended on the traction mechanisms can accordingly be tipped, and certainly in any direction whatsoever, because the pivoted position of the cross-beam can be selected by the pivot head independently of the pivot position of the telescopic boom about the axis of the storage rack.

BRIEF DESCRIPTION OF THE DRAWING

The inventive object is illustrated by way of example in the diagrams, in which.

DETAILED DESCRIPTION OF THE PREFERRED EMBODIMENTS

Figure 1:
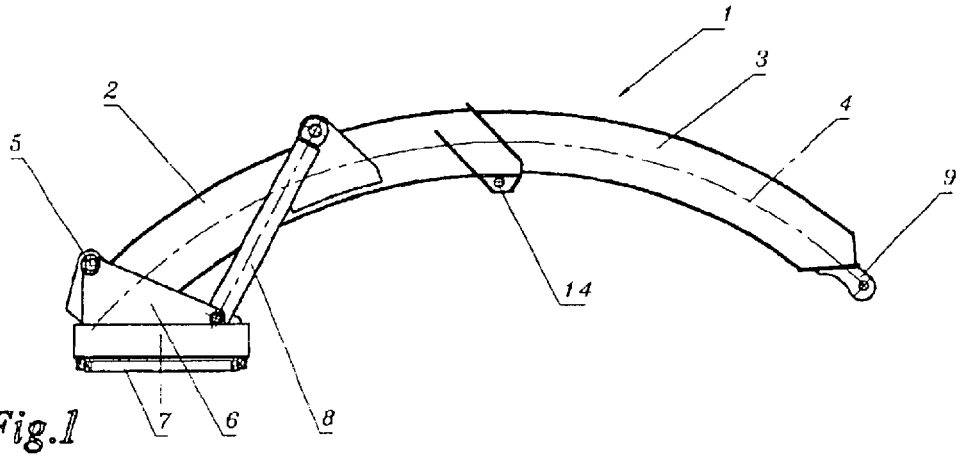
FIG. 1 shows a telescopic boom according to the present invention for a vehicle or a hoist in side elevation.
Figure 2:
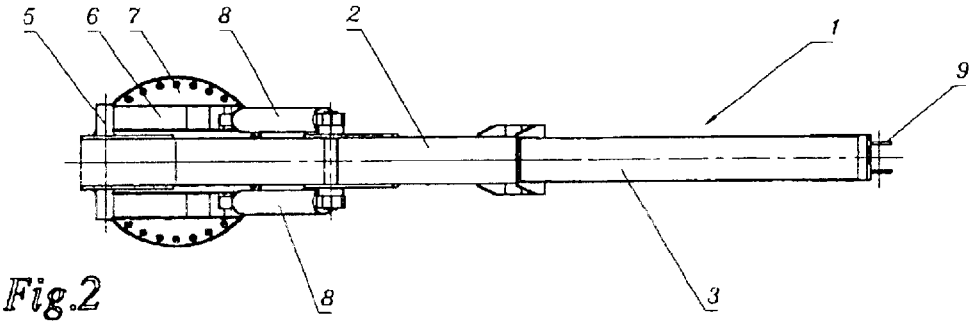
FIG. 2 shows this telescopic boom in a plan view.
Figure 3:
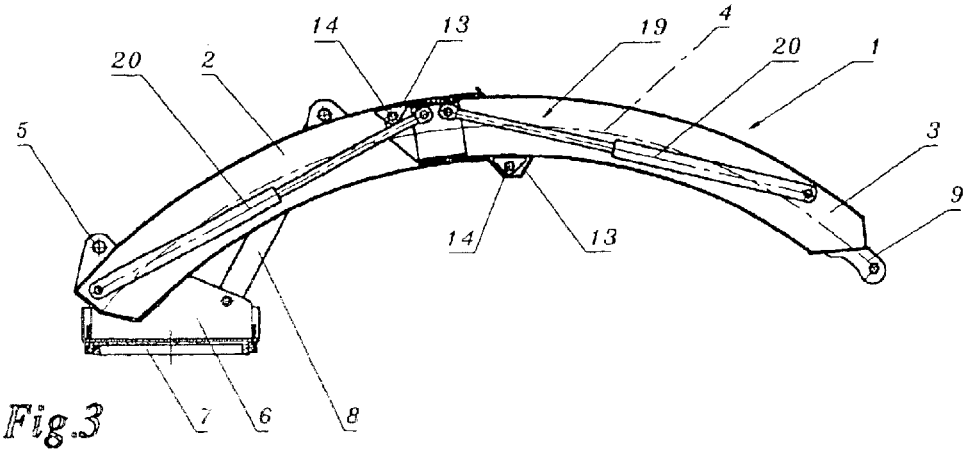
FIG. 3 shows the telescopic boom in longitudinal section.
Figure 4:
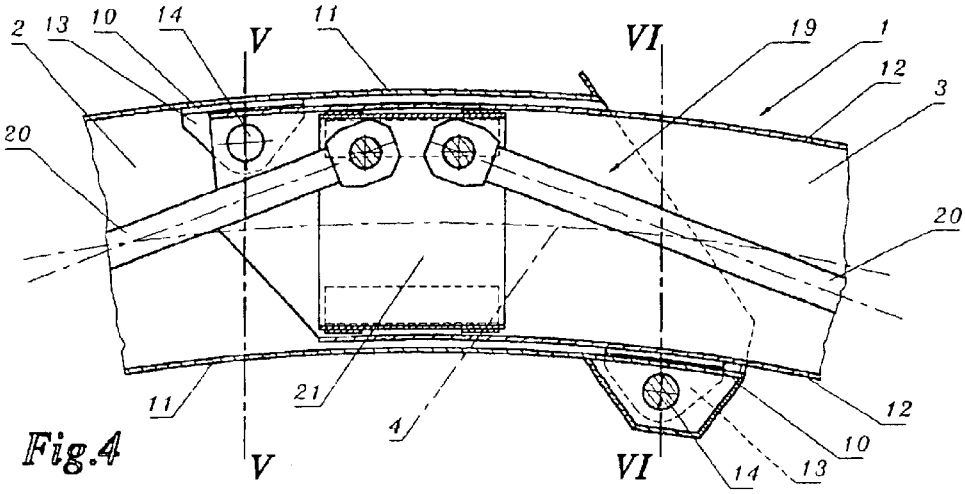
FIG. 4 shows the telescopic boom in section according to FIGS. 1 to 3 in the vicinity of the intermeshing ends of the box girders in longitudinal section on an enlarged scale.

Telescopic boom 1 according to FIGS. 1 to 6 comprises two box girders 2 and 3 guided displaceably in one another whose longitudinal axles form an upwards arched circular arc 4. Lower telescopic boom 2 is swivel-mounted about a horizontal pivot axis 5 in a storage rack 6 which can be rotated by a rotary table 7 about vertical axis, so that telescopic boom 1 can be adjusted about two axes vertical to one another. The drive for pivotally adjusting telescopic boom 1 about pivot axis 5 comprises two pivot cylinders 8 which are linked to both sides of telescopic boom 1 between lower box girder 2 and storage rack 6. Upper box girder 3 guided displaceably in lower box girder 2 bears on its front end a connecting fork 9 for load uptake. According to FIGS. 4 to 6 slideways 10, which are arranged in the region of the rear end of upper box girder 3 and in the region of the front end of lower box girder 2, are provided to guide upper box girder 3 in inner box girder 2, so that said slideways 10 effectively secure box girder 3 inside box girder 2 from tilting, and with adequate play between the cylindrical upper and lower walls 11 and 12 of box girders 2 and 3. So that slideways 10 allow independent tolerance compensation with respect to the respective curvature of walls 11 and 12, said slideways 10 are arranged on pivot members 13 which are swivel-mounted on axles 14 parallel to pivot axle 5.

Figure 5:
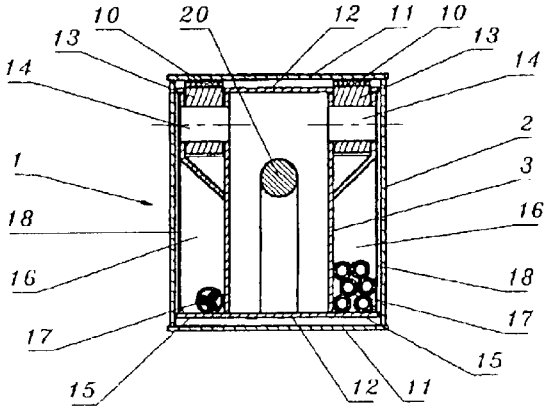
FIG. 5 shows a section according to line V—V in FIG. 4.
Figure 6:
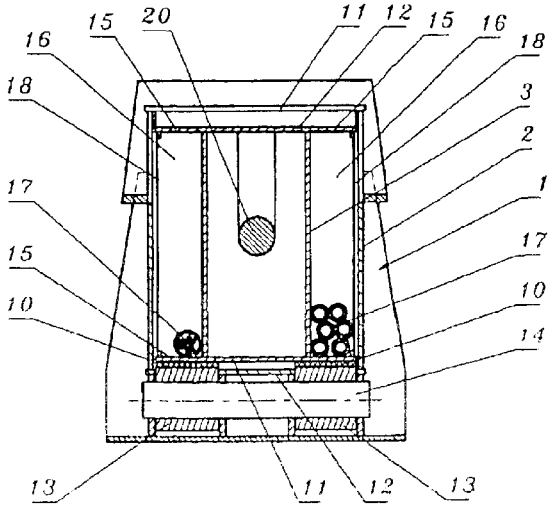
FIG. 6 shows a section according to line VI—VI in FIG. 4.

As evident from FIGS. 5 and 6, the upper and lower cylindrical walls 12 of inner box girder 3 of telescopic boom 1 are elongated laterally beyond the box profile and with these projecting parts form longitudinal edge frames 15, by means of which box girder 3 is supported on the side walls of box girder 2. This lateral extension of the cross-section of box girder 3 not only offers advantages relative to the carrying capacity of box girder 3, but also enables the formation of longitudinal channels 16 for taking up various supply lines 17 running between longitudinal edge frames 15 outside the box profile on both sides of inner box girder 2. So that these supply lines can be protected from outside influences not only in the retraction zone between box girders 2 and 3, but also in the region of the overhang length of box girder 3, longitudinal channels 16 can be closed off outwardly by caps 18.

Figures 7, 8:
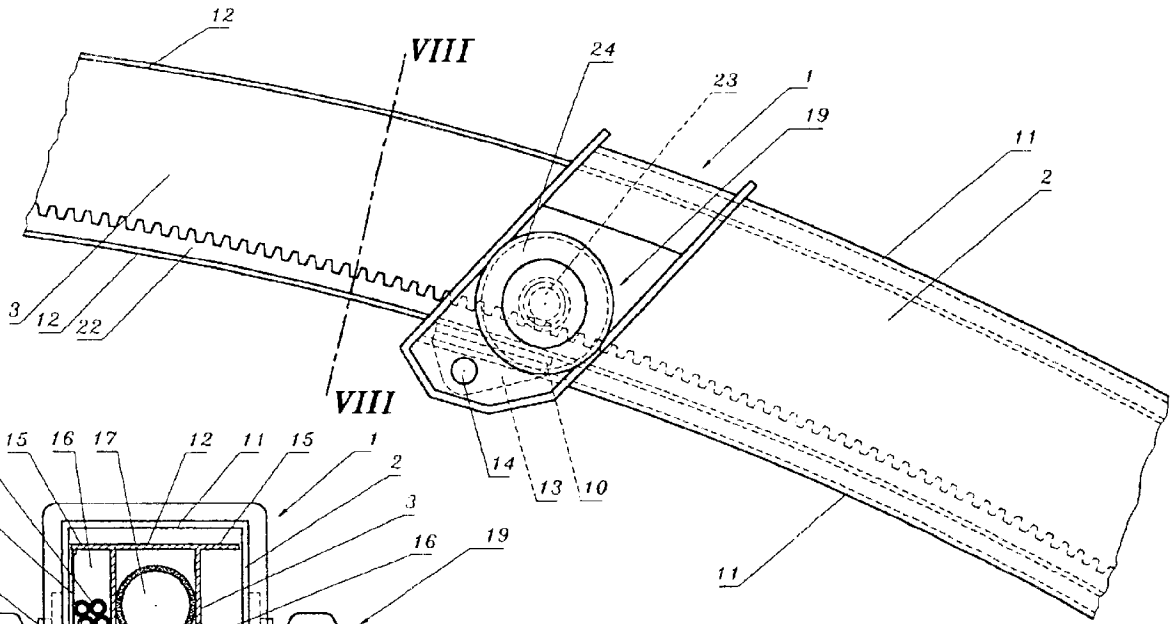
FIG. 7 shows a structural variant of a telescopic boom according to the present invention in section in side elevation on an enlarged scale.
FIG. 8 shows a section according to line VIII—VIII in FIG. 7.

For mutual displacement of intermeshing box girders 2 and 3 a servo-drive 19 is required. According to FIGS. 3 and 4 said servo-drive 19 comprises two rams 20 which on the one hand are each articulated to one of the outer girder ends and on the other hand to a common slider 21 swivel-mounted inside box girder 3. Through this arrangement of two rams 20 arranged chord-like relative to arc 4 inside box girders 2 and 3 achieves the adaptation of telescopic boom 1 to the circular arc shape is achieved, so that despite the circular arc form simple rams 20 must not be dispensed with. Due to the displaceable bearing of slider 21 relative to box girder 3 when ram 20 assigned to said box girder 3 is supplied upper box girder 3 is extended relative to lower box girder 2 along circular arc 4.

servo-drive 19 may also, however, comprise at least one rack 22 running along one box girder, in the embodiment as in FIGS. 7 and 8 along upper box girder 3, which meshes with a driving pinion 23 arranged in the front end region of box girder 2 on the storage rack side. According to FIG. 8 two such racks 22 meshing with driving pinions 23 are provided, and in fact in the region of longitudinal channels 16, on both sides of the box profile, in such a way that a geared motor 24 is flanged on box girder 2 for driving each of driving pinions 23. This configuration of servo-drive 19 frees the box profile for laying large-diameter supply lines 17. The space of longitudinal channels 16 not utilised by the rack pinions can additionally serve to take up supply lines 17, as indicated in FIG. 8.

Figure 9:
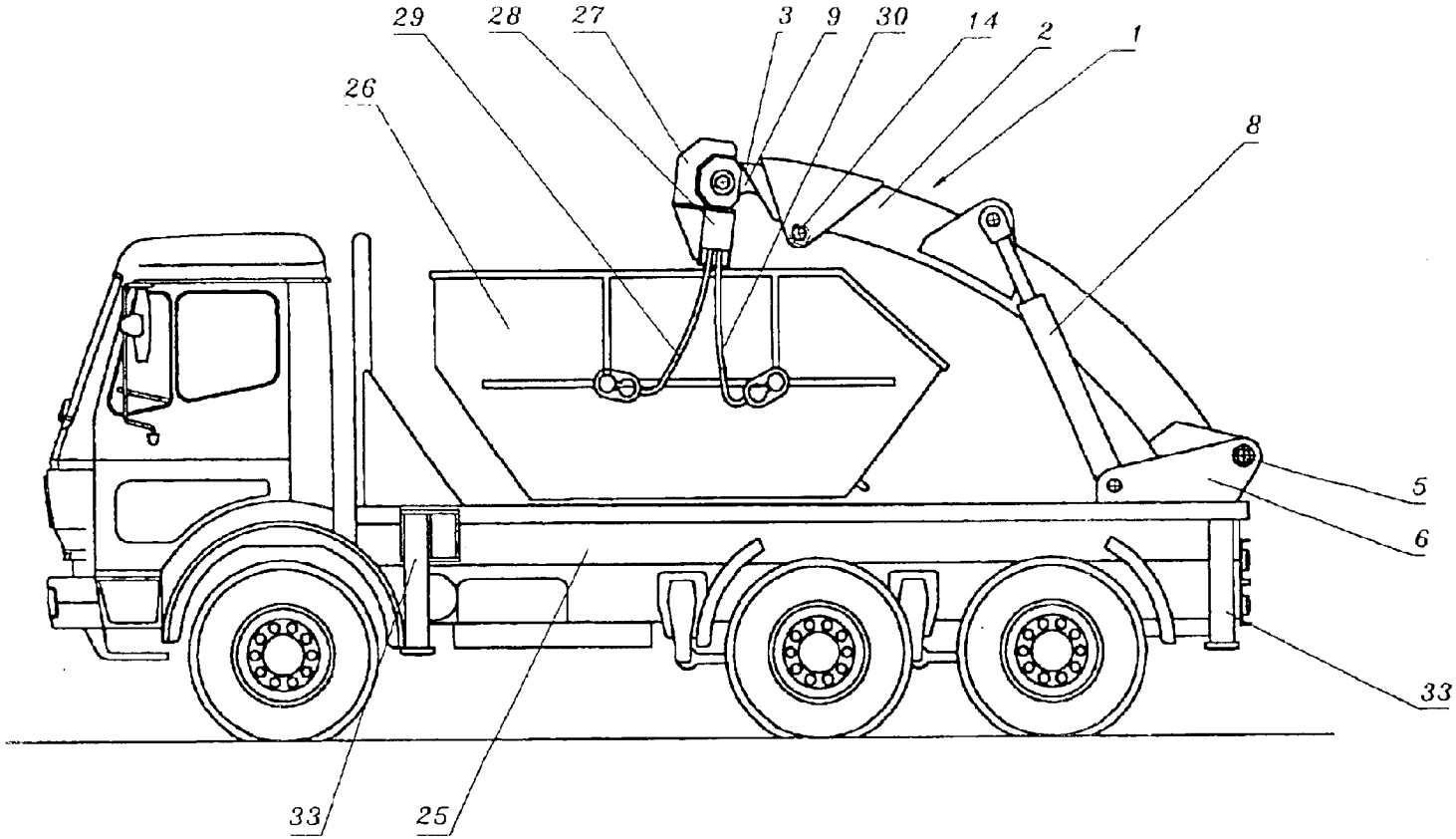
FIG. 9 shows a vehicle fitted with a telescopic boom according to the present invention for taking up set-down bins in side elevation.
Figure 10:
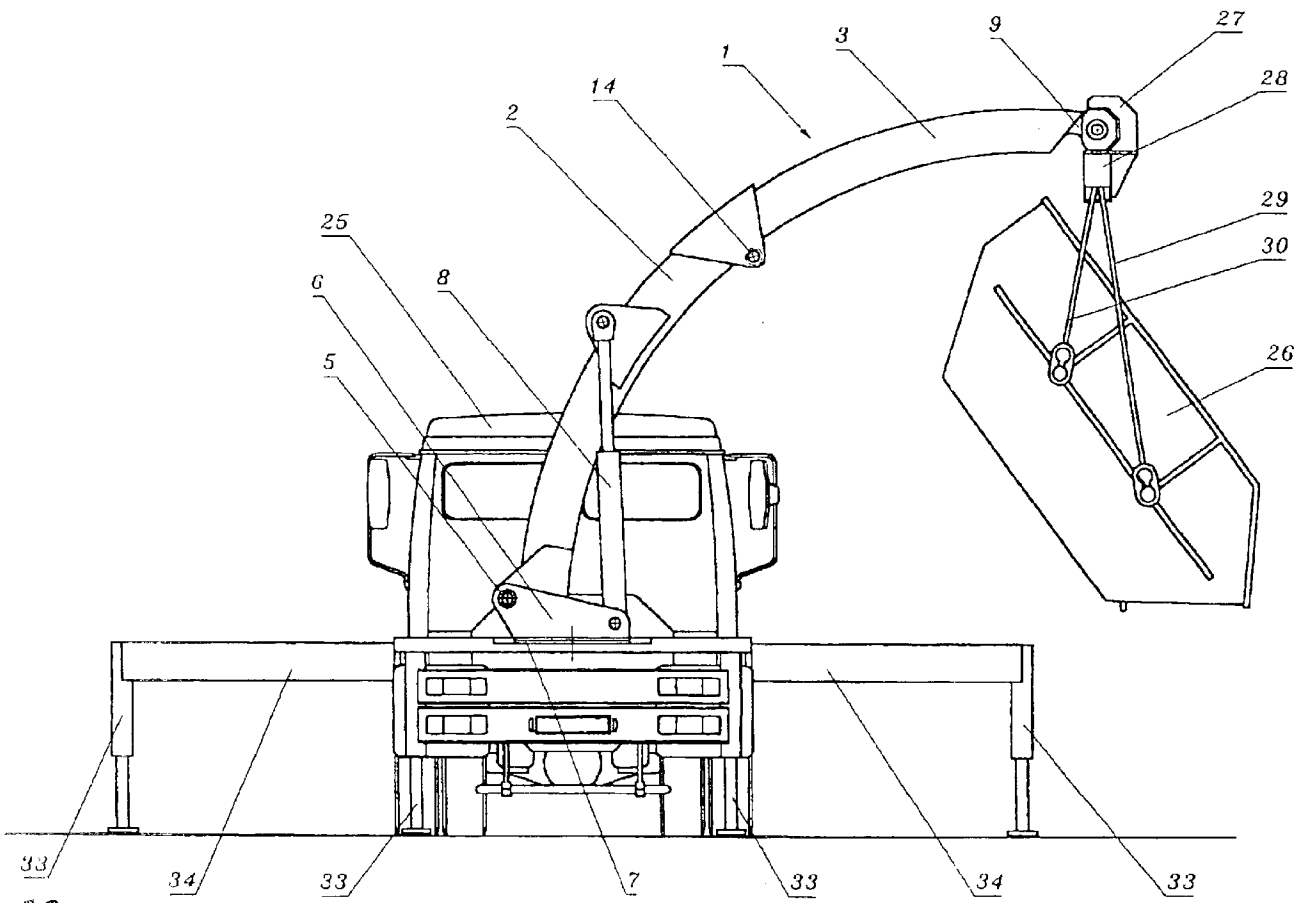
FIG. 10 shows the vehicle according to FIG. 9 in a rear view with a bin tipped on the side of a vehicle.
Figure 11:
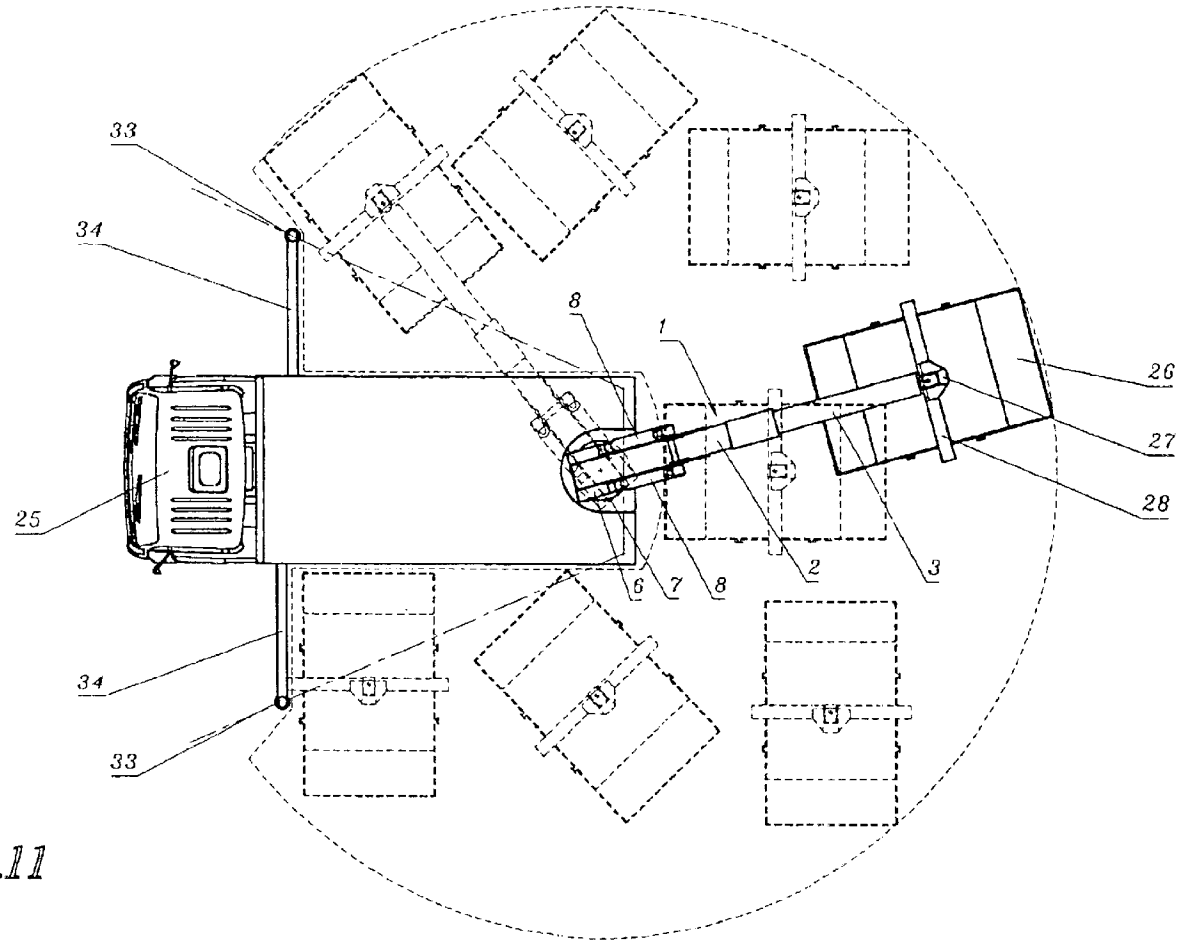
FIG. 11 shows a plan view of the vehicle in FIGS. 9 and 10 with different set-down positions for a bin on a reduced scale.
Figure 12:
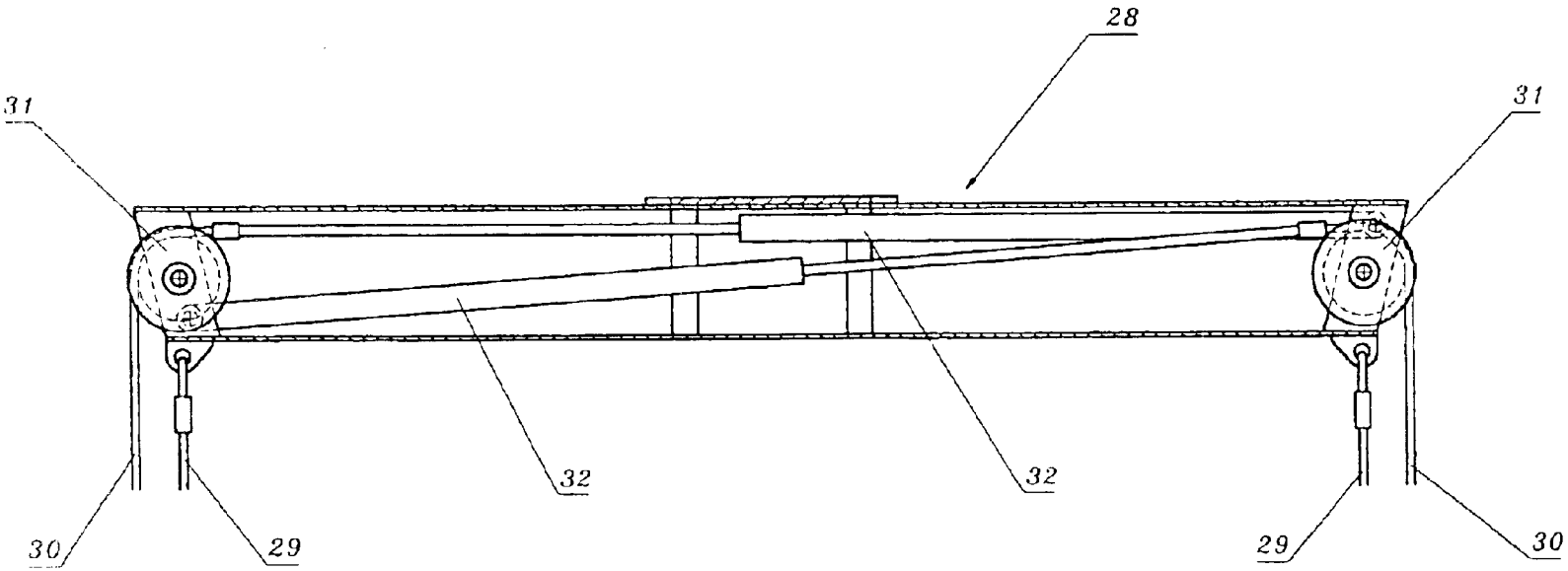
FIG. 12 shows a longitudinal section through the cross-beam of the load suspension gear of the telescopic boom as in FIGS. 9 to 11 on an enlarged scale.

FIGS. 9 to 11 illustrate an advantageous application of a telescopic boom 1 according to the present invention in a vehicle 25 for taking up set-down bins 26. For this purpose telescopic boom 1 is mounted with its storage rack 6 via a rotary table 7 in the rear region of vehicle 25 and by way of its connecting fork 9 bears a pivot head 27 which is connected to a cross-beam 28 of load suspension gear which exhibits respectively two traction mechanisms 29 and 30 for suspended bins 26 on both sides of cross-beam 28. Whereas of said traction mechanisms 29 and 30 arranged in pairs traction mechanism 29 engages tensilely on cross-beam 28, according to FIG. 12 traction mechanism 30 is fed by way of a deflection sheave 31 respectively to a hydraulic jack 32, such that traction mechanisms 30 can be tightened when hydraulic jacks 32 are supplied, in order to tip suspended bin 26, as is evident from FIG. 10. Due to the circular arc shape of telescopic boom 1 bin 26 can be set down and picked up in any orientation within the set-down region of telescopic boom 1 indicated in FIG. 11, by cooperating with pivot head 27 for cross-beam 28, without any additional hoisting equipment having to be provided for the load suspension gear. It is understood that provision can also be made for corresponding height adjustment of the load suspension gear. The chassis of vehicle 25 is supported in a conventional manner via stanchions 33 which are attached in the front region of the loading surface to retractable and extensible bracing cantilevers 34.

Figure 13:
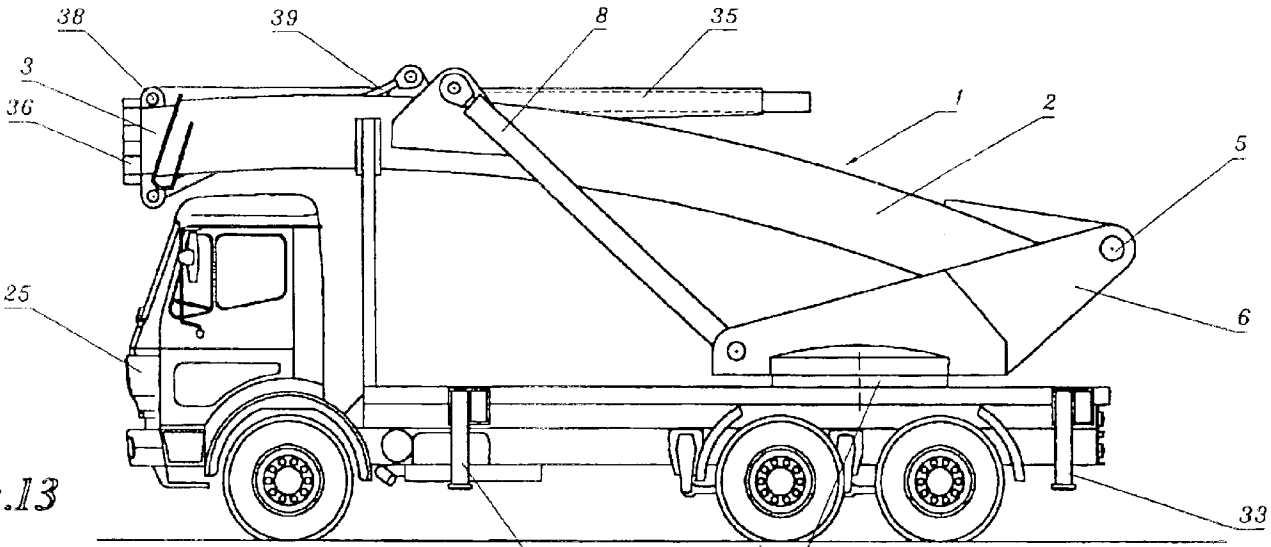
FIG. 13 shows a telescopic boom placed on a vehicle for guiding a supply line for ready-made concrete.
Figure 14:
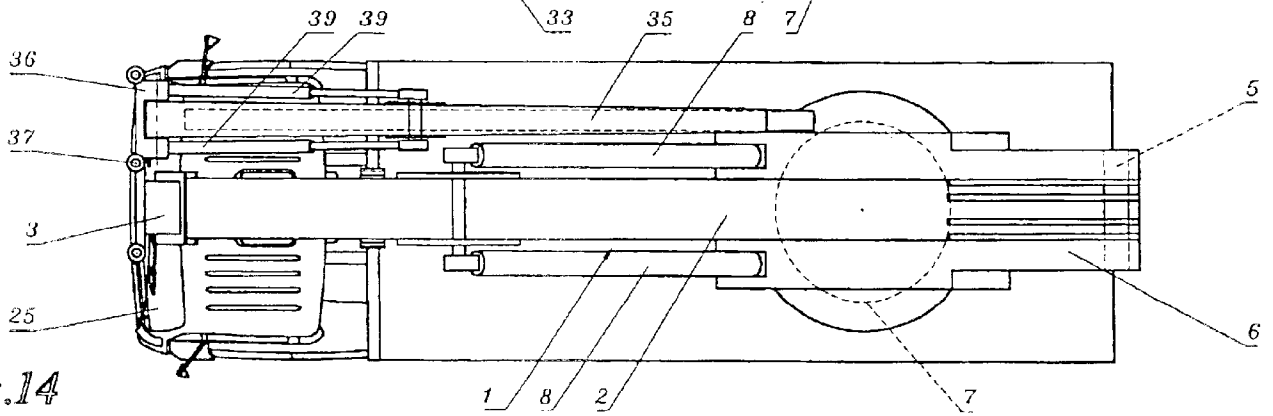
FIG. 14 shows the vehicle as in FIG. 13 in a plan view.
Figure 15:
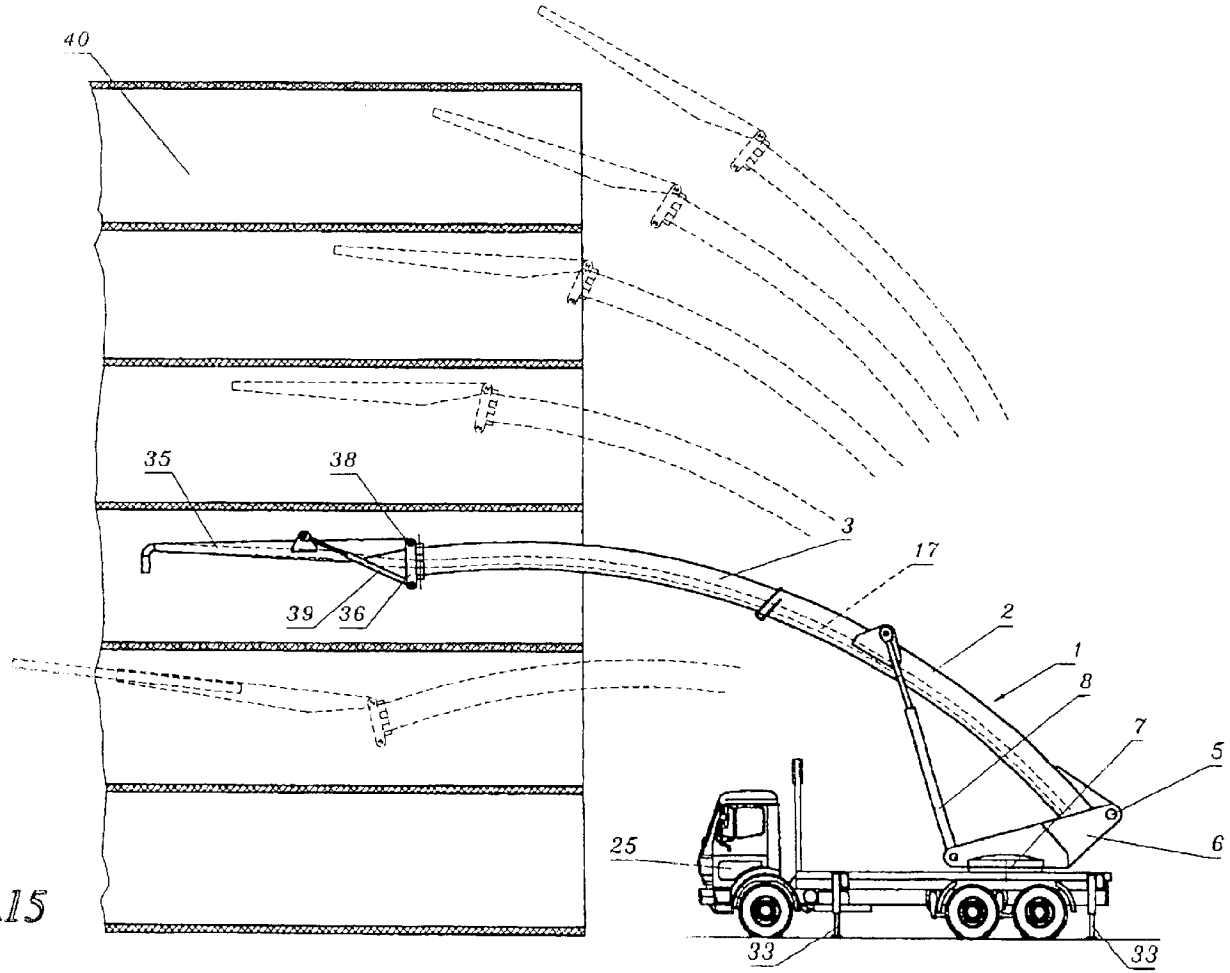
FIG. 15 shows the vehicle as in FIGS. 13 and 14 in side elevation with extended telescopic boom on a reduced scale.

The embodiment according to FIGS. 13 to 15 illustrates a vehicle 25 with a telescopic boom 1 which serves to guide a supply line 17 for ready-made concrete, for example. With its lower box girder 2 extending substantially over the length of the vehicle in a storage rack 6 said telescopic boom 1 is swivel-mounted about a horizontal pivot axle 5 and can be rotated by rotary table 7 about a vertical axis. To extend the reach of telescopic boom 1, a cantilever arm 35 is linked to the front end of upper box girder 3, and in fact by way of a connecting frame 36 which can be shifted about a lateral axle 37 running transversely to box girder 3 into a laterally pivoted transport position, in which cantilever arm 35 comes to rest laterally next to telescopic boom 1, as is evident from FIGS. 13 and 14. In the use position, in which connecting frame 36 swivelled to in front of the front face of box girder 3 is locked with box girder 3, cantilever arm 35 can be pivoted about a pivot axis 38 parallel to pivot axis 5 of telescopic boom 1 by means of a pivoting cylinder pair 39 articulated between connecting frame 36 and cantilever arm 35 as required. These measures enable supply line 17 to be inserted through lateral openings into spaces which cannot otherwise be reached by a straight telescopic boom, as illustrated in FIG. 15, in which different pivot positions of telescopic boom 1 and of linked cantilever arm 35 are indicated, for ready-made concrete for example to be supplied via supply line 17 into various upper-level areas of a building 40.

Figure 17:
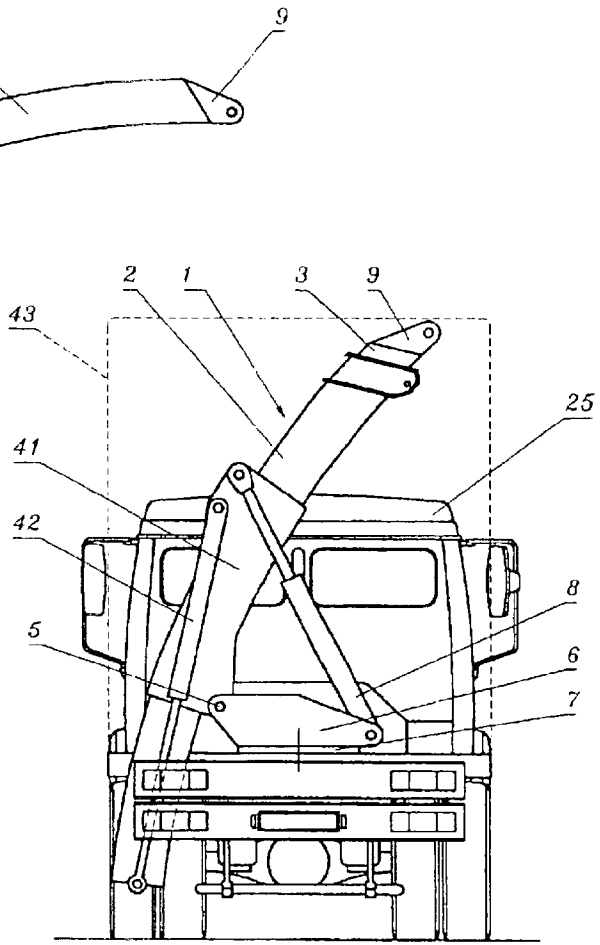
FIG. 17 shows the vehicle as in FIG. 16 with retracted telescopic boom.
Figure 16:
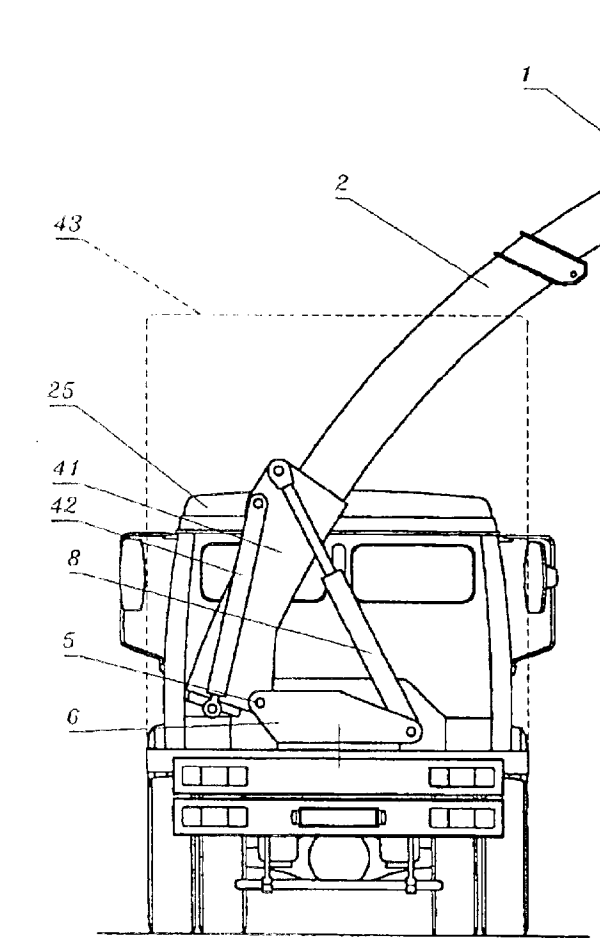
FIG. 16 shows a vehicle with an extended three-part telescopic boom in a rear view.

FIGS. 16 and 17 illustrate a telescopic boom 1 for a hoist fitted on a vehicle 25, whose load suspension is not illustrated for clarity. In contrast to previously described telescopic booms telescopic boom 1 is composed of three box girders 2, 3 and 41guided displaceably in one another. Whereas box girders 2 and 3 can be shifted reciprocally by means of a servo-drive as per FIG. 3 or 7, middle box girder 2 is mounted telescopically in both directions in box girder 41, which is swivel-mounted on storage rack 6, where rams 42 are provided for mutual displacement, which engage externally on both sides of telescopic boom 1 at the upper end of box girder 41 on the storage rack side and at the lower end of middle box girder 2. In the transport position illustrated in FIG. 17 middle box girder 2 projects downwards over box girder 41 on the storage rack side, so that telescopic boom 1 comes to rest inside a specified contour 43 of vehicle 25. The full length of three-part telescopic boom 1 can be utilised in the extended working position as in FIG. 16.

Figure 18:
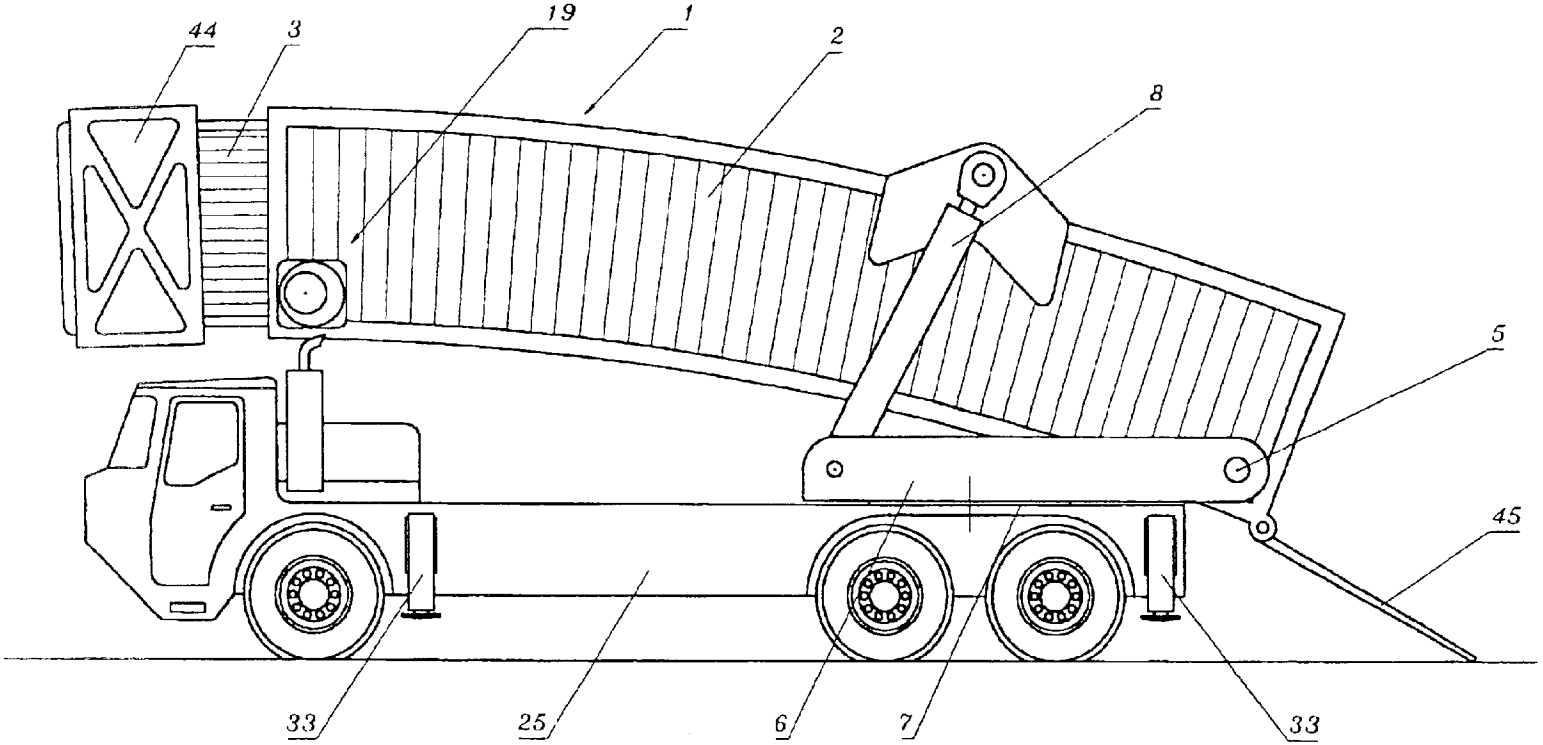
FIG. 18 shows a vehicle with a telescopic boom forming an accessible tunnel in a simplified side elevation.

FIG. 18 finally illustrates a telescopic boom 1 which forms a navigable or accessible tunnel with its box girders 2 and 3, in such a way that box girder 3 forms a connection 44 at its front end facilitating transition to its lateral opening. Such a telescopic boom 1 can aid in creating exit hatches for aircraft or emergency and escape routes which allow people to advantageously and easily reach the ground by way of openings which exhibit a corresponding distance from the ground. Similarly to connection 44, at the same time box girder 2 on the storage rack side can be equipped with a sealing cap 45 which facilitates transition from box girder 2 to the ground when in the unfolded position.

It probably does not need to be particularly emphasised that application of telescopic booms 1 according to the present invention is not limited to the illustrated embodiments. Such telescopic booms 1 could also be used beneficially in fire engines, for example. What matters in particular is that the telescopic boom is moved along a curved path by the circular-arc arrangement of the box girders in order to improve the reach of these telescopic booms.

What is claimed is:

1. A telescopic boom mounted for pivoting about a horizontal pivot axis on a mounting bracket arranged on a vehicle, which comprises two box girders extending in a longitudinal direction in upwardly arched arcs of a circle and a first one of the box girders being guided in a second one of the box girders for displacement in the longitudinal direction, the upwardly arched arcs of a circle having a common axis extending parallel to the pivot axis, a servo-drive for displacing the box girders relative to each other, the first box girder having an end extending into an end of the second box girder and the servo-drive comprising two fluid-operated cylinders for displacing the box girders relative to each other, each cylinder having one end linked to an outer end of a respective one of the box girders and an opposite end linked to a common slider mounted displaceably in the end of the first box girder.

2. The telescopic boom of claim 1, wherein the two box girders have ends interengaging with play, comprising two slideways pivotal about axes extending parallel to the pivot axis, one of the slideways being supported at a top of the end of the first box girder end the other slideway being supported at a bottom of the end of the second box girder.

3. The telescopic boom of claim 1, wherein the first box girder has an upper and a lower arcuate wall, the upper and lower arcuate walls having laterally projecting longitudinal edges guided along the second box girder.

4. The telescopic boom of claim 1, wherein an outer end of the first box girder carries a pivotally adjustable cantilever arm.

5. The telescopic boom of claim 4, wherein the cantilever arm is extendible.

6. A vehicle capable of accommodating a removable bin having lateral sides, which comprises a telescopic boom mounted for pivoting about a horizontal pivot axis on a mounting bracket arranged on the vehicle, the telescoping boom comprising two box girders extending in a longitudinal direction in upwardly arched arcs of a circle and a first one of the box girders being guided in a second one or the box girders for displacement in the longitudinal direction, the upwardly arched arcs of a circle having a common axis extending parallel to the pivot axis, a pivotal head attached to an outer end of the first box girder, a cross-beam mounted on the pivotal head, a traction mechanism connected to the cross-beam, the traction mechanism comprising a pair of traction elements at respective ends of the cross-beam for gripping the lateral sides of the removable bin, at least one of the traction elements of each pair of traction elements being adjustable relative to the other traction element of said pair and a servo-drive for displacing the box girders relative to each other.

7. The vehicle of claim 6, further comprising hydraulic jacks arranged in the cross beam and having ends thereof connected to the adjustable traction elements for adjusting the same.

* * * * *